US009784026B2

(12) United States Patent
Chow

(10) Patent No.: US 9,784,026 B2
(45) Date of Patent: Oct. 10, 2017

(54) SAFE WITH LATCH AND KEY LOCK

(71) Applicant: Leslie Ho Leung Chow, Shilouzhen Panyu District (CN)

(72) Inventor: Leslie Ho Leung Chow, Shilouzhen Panyu District (CN)

( * ) Notice: Subject to any disclaimer, the term of this patent is extended or adjusted under 35 U.S.C. 154(b) by 0 days.

(21) Appl. No.: 14/297,451

(22) Filed: Jun. 5, 2014

(65) Prior Publication Data

US 2015/0354262 A1 Dec. 10, 2015

(51) Int. Cl.
*E05G 1/04* (2006.01)
*E05G 1/00* (2006.01)
*E05G 1/024* (2006.01)

(52) U.S. Cl.
CPC ..... *E05G 1/04* (2013.01); *E05G 1/005* (2013.01); *E05G 1/024* (2013.01)

(58) Field of Classification Search
CPC E05G 1/00; E05G 1/005; E05G 1/026; E05G 1/04
USPC ..... 109/59 R, 73, 74
See application file for complete search history.

(56) References Cited

U.S. PATENT DOCUMENTS 828,423 A * 8/1906 Rnsom ..... E05C 19/14 70/73
4,768,021 A * 8/1988 Ferraro ..... 109/53
5,153,561 A * 10/1992 Johnson ..... 70/278.1
5,479,341 A * 12/1995 Pihl et al. ..... 700/79
6,845,640 B2 * 1/2005 Loeff et al. ..... 109/45
6,883,440 B1 * 4/2005 Correia ..... 109/59 R
7,350,470 B1 * 4/2008 Stuhlbarg et al. ..... 109/73
7,826,220 B1 * 11/2010 Baker ..... 109/73
8,479,543 B2 * 7/2013 Yang et al. ..... 109/59 R
8,689,591 B2 * 4/2014 Elsner et al. ..... 70/278.7
9,004,546 B2 * 4/2015 Dunstan ..... 109/70
9,422,745 B2 * 8/2016 Chow ..... E05B 65/00

* cited by examiner

*Primary Examiner* — Christopher Boswell
(74) *Attorney, Agent, or Firm* — John R. Ross; John R. Ross, III

(57) ABSTRACT

A safe. A safe lid is connected to a safe box via a hinge. A fascia assembly is connected to the safe lid and a latch assembly is connected to the safe box. The fascia assembly includes a keypad and a fascia assembly locking groove. The latch assembly includes a latch having a fascia assembly locking tab and a lock latch locking tab. The latch assembly also has a lock lever pivotally connected to the latch and the latch assembly. A motor in the latch assembly receives electrical inputs from the keypad. The latch assembly also has a key lock. A lock latch is connected to and controlled by the motor and the key lock. A lock latch reset spring is connected to the lock latch. The safe is locked when the fascia assembly locking tab is inserted into the fascia assembly locking groove and also when the lock latch locking tab is secured behind the lock latch. The safe is unlocked by entering a pass code into the key pad. This caused an electrical signal to be transmitted to the motor. The motor then operates to move the lock latch so that it releases the lock latch locking tab. The safe can also be opened by turning the key lock to move the lock latch so that it releases the lock latch locking tab.

4 Claims, 8 Drawing Sheets

SAFE WITH LATCH AND KEY LOCK

BACKGROUND OF THE INVENTION

Safe boxes (also known as "safes") are well known in the prior art. They are used primarily to protect documents, currency, jewelry, and other valuables from fire and theft. Stand alone safes are very common in homes and businesses throughout the world. A fire-resistant safe (also known as a "fireproof safe" or a "fire safe") is a type of safe that is designed to protect its contents from high temperatures or actual fire. There are various types of locking mechanisms currently being utilized for safes that incorporate known technologies.

Nitinol Wire

Nitinol Wire (also known as 'Muscle Wire' or 'Memory Wire') is a thin strand of a special shape memory alloy composed primarily of Nickel (Ni) and Titanium (Ti). Nitinol Wire will shorten in length after receiving an electrical signal, or heated by other means. Nitinol wire returns to its original length the electrical signal is removed and/or cooled.

What is needed is a better safe that allows operation through a user controlled keypad as well as a backup operation via a hand held key.

SUMMARY OF THE INVENTION

The present invention provides a safe. A safe lid is connected to a safe box via a hinge. A fascia assembly is connected to the safe lid and a latch assembly is connected to the safe box. The fascia assembly includes a keypad and a fascia assembly locking groove. The latch assembly includes a latch having a fascia assembly locking tab and a lock latch locking tab. The latch assembly also has a lock lever pivotally connected to the latch and the latch assembly. A motor in the latch assembly receives electrical inputs from the keypad. The latch assembly also has a key lock. A lock latch is connected to and controlled by the motor and the key lock. A lock latch reset spring is connected to the lock latch. The safe is locked when the fascia assembly locking tab is inserted into the fascia assembly locking groove and also when the lock latch locking tab is secured behind the lock latch. The safe is unlocked by entering a pass code into the key pad. This caused an electrical signal to be transmitted to the motor. The motor then operates to move the lock latch so that it releases the lock latch locking tab. The safe can also be opened by turning the key lock to move the lock latch so that it releases the lock latch locking tab.

DETAILED DESCRIPTION OF THE PREFERRED EMBODIMENTS

Figures 1A, 1B, 1C:
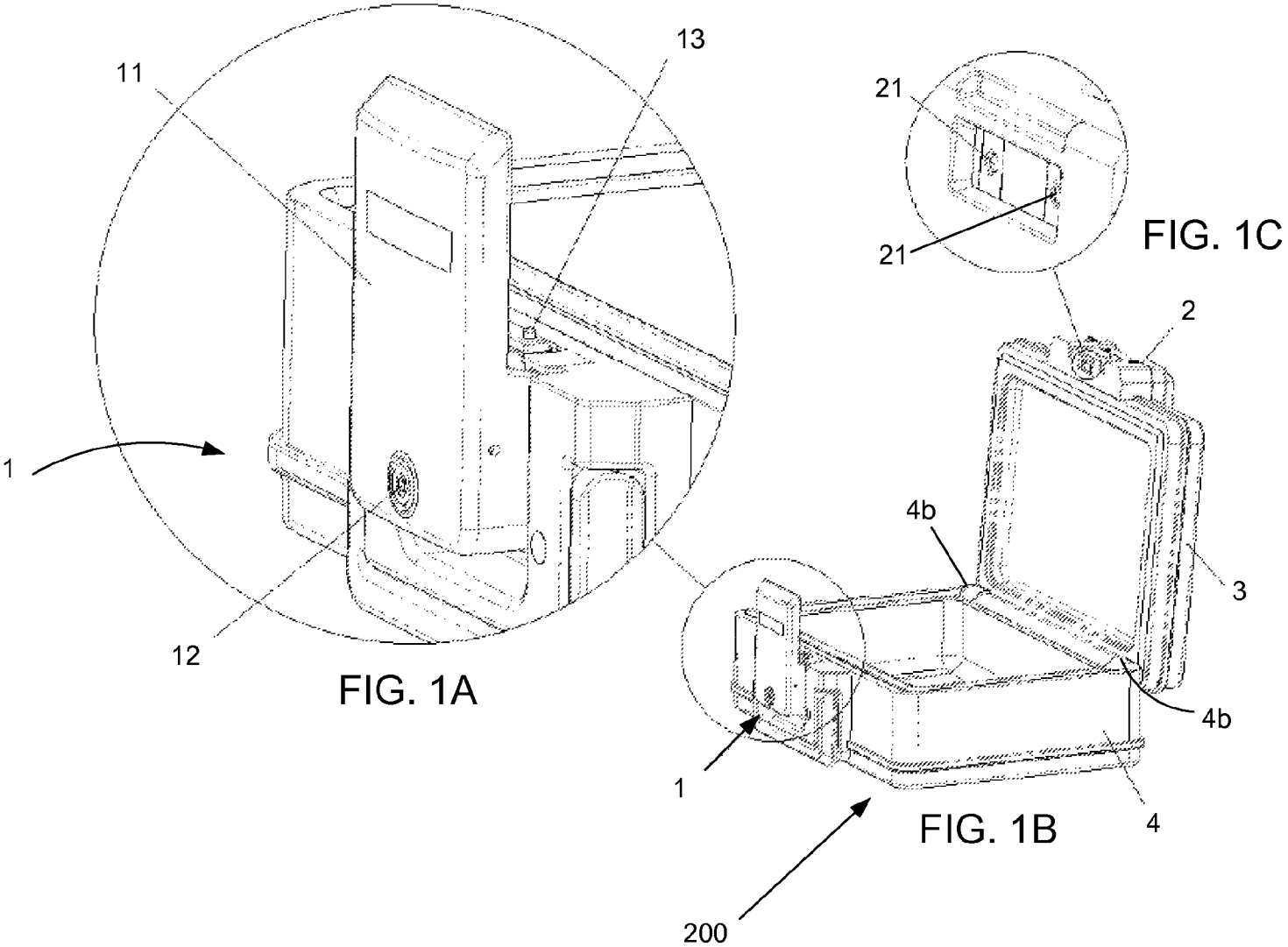
FIGS. 1A-1C show a preferred embodiment of the present invention.
Figure 4:
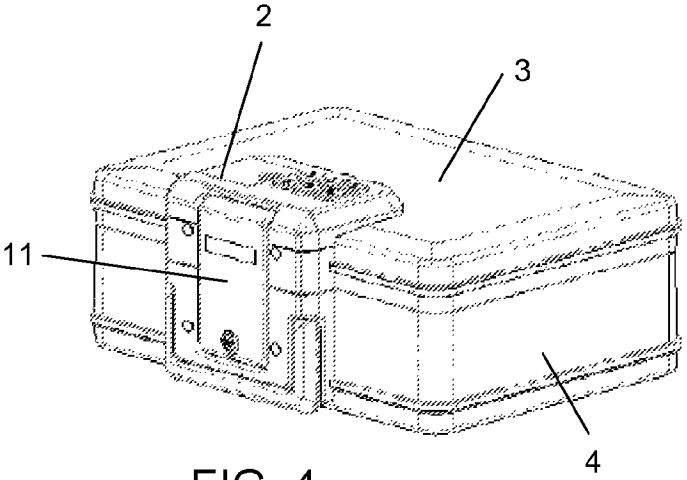
FIG. 4 shows a preferred embodiment of the present invention.

Chest 200 includes latch assembly 1, fascia assembly 2, lid 3 and box 4 (see FIG. 1B and FIG. 4). Latch assembly 1 is connected to box 4 and fascia assembly 2 is connected to lid 3. Lid 3 is connected via hinges 4*b* to box 4.

Figure 2A:
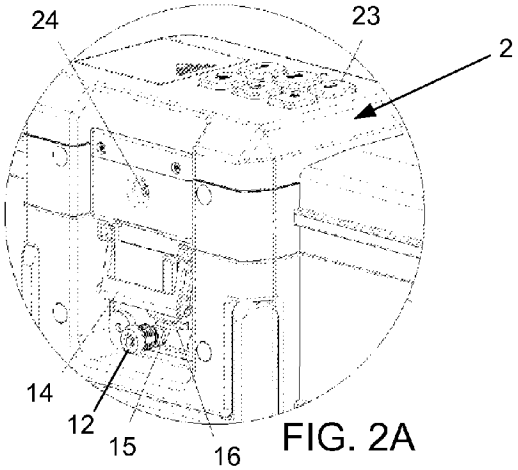
FIGS. 2A-2B shows perspective views of components of a preferred latch assembly.
Figure 2B:
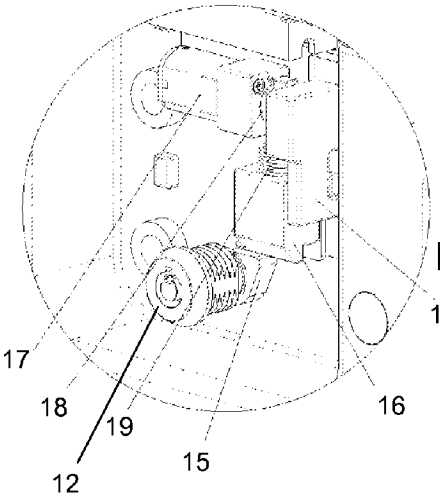
Figure 2D:
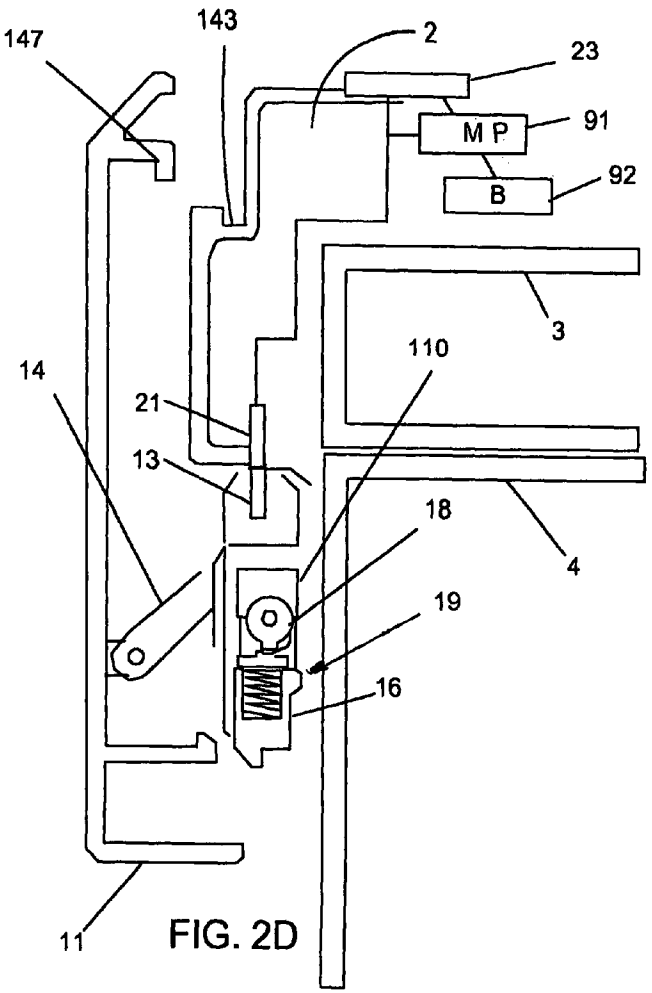
FIGS. 2C-2D show the operation of a preferred embodiment of the present invention.
Figure 2C:
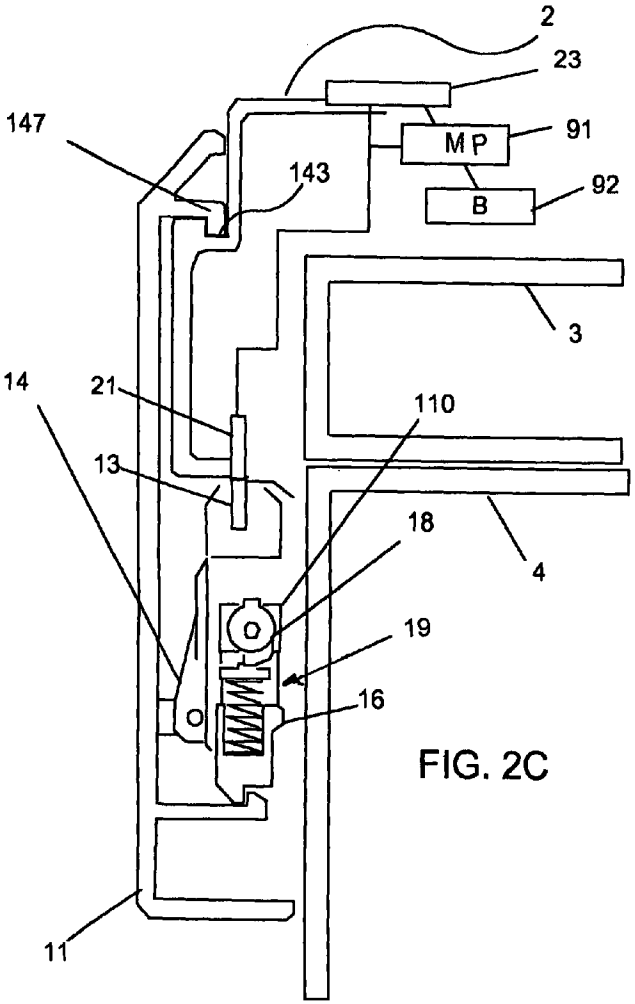
Figure 3:
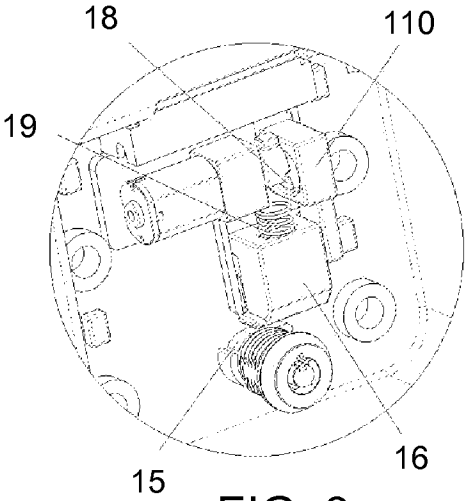
FIG. 3 shows another perspective view of components of a preferred latch assembly.

Lid 3 and box 4 are locked together via latch 11 as shown in FIG. 2C. When latch 11 is in the closed and locked position, it is locked down by lock latch 16 and locking tab 147 (see FIG. 2C). Locking tab 147 at the upper portion of latch 11 engages groove 143 of fascia assembly 2 and latch 16 engages the lower portion of latch 11 to lock lid 3 onto box 4.

Using a Key Pad to Unlock the Safe

As shown in FIGS. 2C-2D, key pad 23 is attached to fascia assembly 2. Pass code reset button 24 (see FIG. 2A) and electrode plates 21 (FIG. 1C) are also connected to fascia assembly 2. Fascia assembly 2 is powered by battery 92 and controlled by microprocessor 91 within key pad 23. When chest 200 is closed as shown in FIG. 2C, the user enters the pass code using key pad 23. Power is then transmitted via electrode plates 21 (which is a part of fascia 2 connected to lid 3) to electrode rods 13 (FIG. 1A) on latch assembly 1 connected to box 4 and through to motor 17 (FIG. 2B). Gear 18 on motor 17 rotates 180 degrees, which moves gear connecting plate 110 upwards compresses spring 19 and releases the lower portion of latch 11 and in turn pushes lock latch 16 upwards against lock lever 14 (FIG. 2D) to release the top portion of latch 11 (FIGS. 1A, 1B and 2D) from fascia assembly 2.

Using a Key Lock to Unlock the Safe

As an alternative, key lock 12 may be utilized to unlock safe 200. For example, as shown in FIGS. 2A-2D, key lock 12 is turned counterclockwise causing lock plate 15 to push upwards on lock latch 16. Lock latch 16 likewise pushes upwards on lock lever 14 and releases latch 11 from fascia assembly 2 (FIG. 2D). Key lock 12 is turned clockwise to reset. Compressed lock plate reset spring 19 pushes lock latch 16 to its original position.

The Latch Moving to the Lock Position

When lid 3 is closed but not locked latch 11 is in the position shown in FIG. 2D. To lock the latch assembly, microprocessor 91 sends a signal to motor 17 as shown in FIG. 2B to turn gear 18 180 degrees so that gear connecting plate 110 is moved to its original position as shown in FIG. 2C. Compressed lock latch reset spring 19 pushes lock latch 16 downward to its locked position. The user pushes latch 11 down against groove 143 on fascia assembly 2 and pushes latch 11 inward towards box and lock latch 16 slides into latch 11 and locks it. During this process spring 19 is temporally compressed then relaxes and expands to lock the bottom portion of latch assembly 1.

Other Possible Actuators for the Motor

As stated above, gear 18 on motor 17 rotates 180 degrees, which moves gear connecting plate 110 upwards and in turn pushes lock latch 16 upwards against lock lever 14 (FIG. 2D) and releases latch 11 (FIGS. 1A, 1B and 2D) from fascia assembly 2. It should be noted that motor 17 can be replaced by other types of actuators that function to move lock latch 16 upwards to clear latch 11.

Figure 6C:
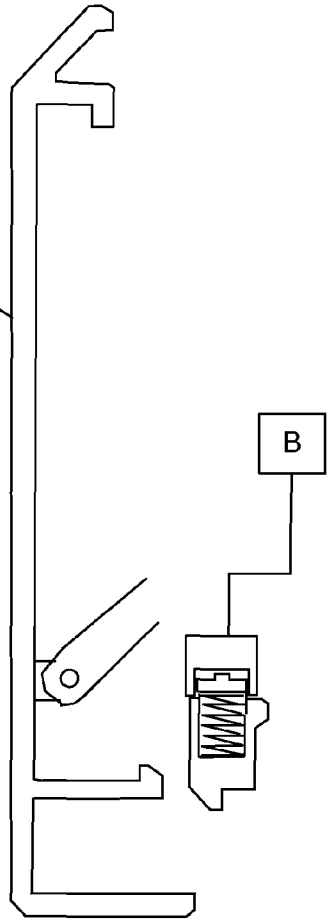
FIGS. 6A-6C show another preferred embodiment of the present invention.
Figure 6B:
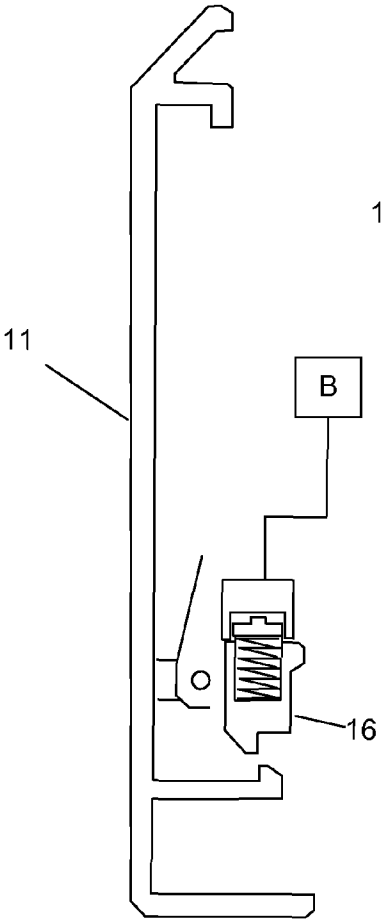
Figure 6A:
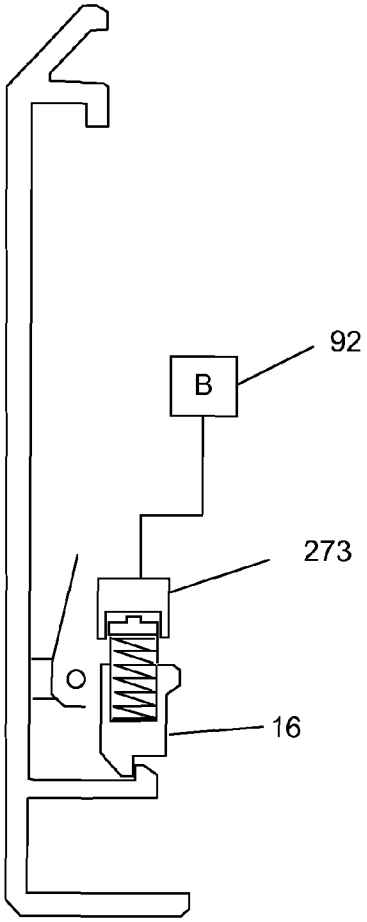

For example, FIGS. 6A-6C show the utilization of solenoid 273 to move latch 16 upwards. In FIG. 6A, an electrical signal from battery 92 has been transmitted to solenoid 273 causing lock latch 16 to move upwards as shown in FIG. 6B. Lock latch 11 is now clear and opens as shown in FIG. 6C.

Figure 7C:
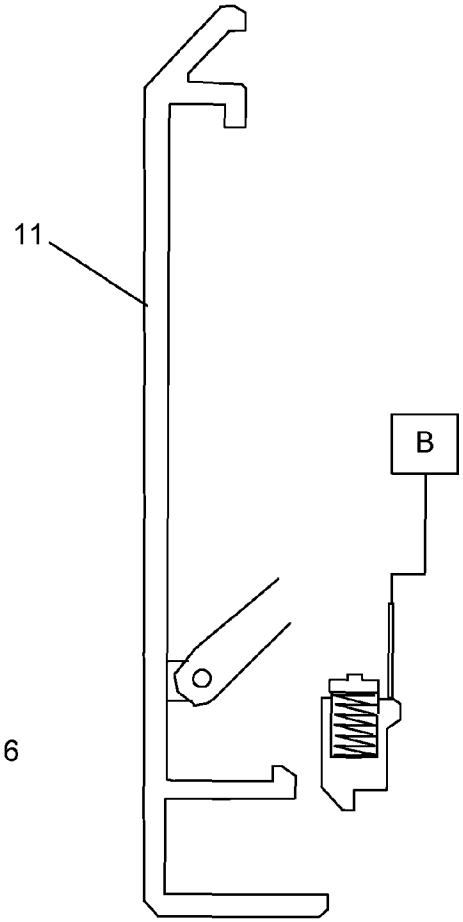
FIGS. 7A-7C show another preferred embodiment of the present invention.
Figure 7B:
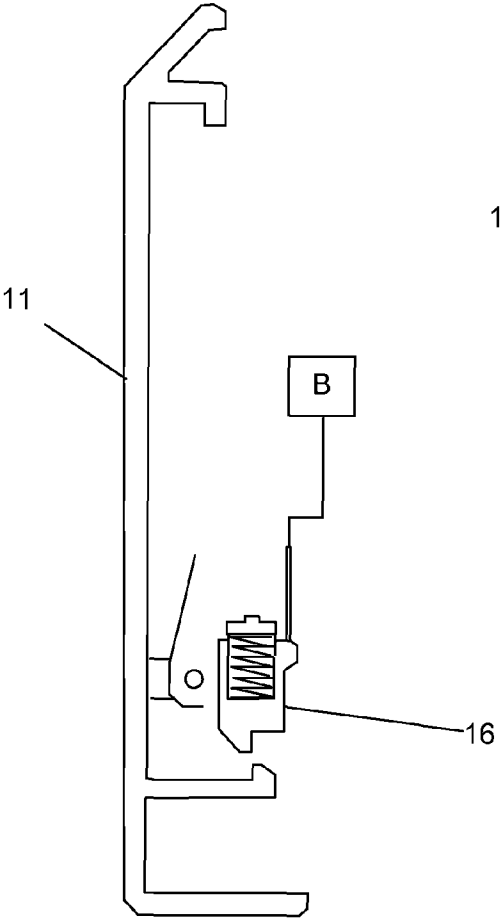
Figure 7A:
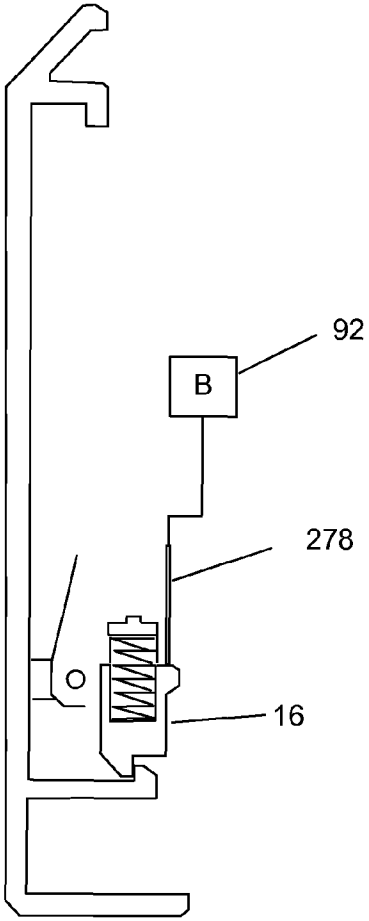

Also, FIGS. 7A-7C show the utilization of nitinol wire 278 to move latch 16 upwards. In FIG. 7A, an electrical signal from battery 92 has been transmitted to nitinol wire 278 causing it to shorten and then causing lock latch 16 to move upwards as shown in FIG. 7B. Lock latch 11 is now clear and opens as shown in FIG. 7C.

Other Embodiments

Figure 4B:
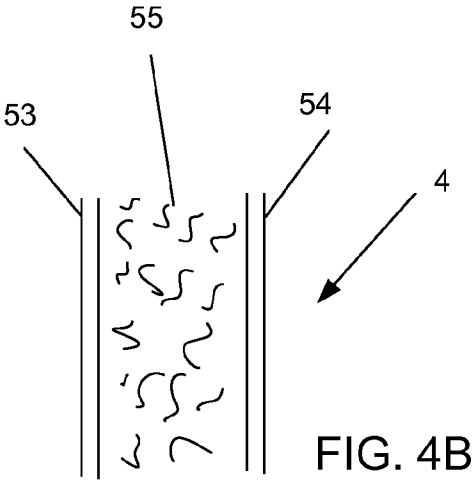
FIG. 4B shows the walls of a preferred fireproof safe.
Figure 5:
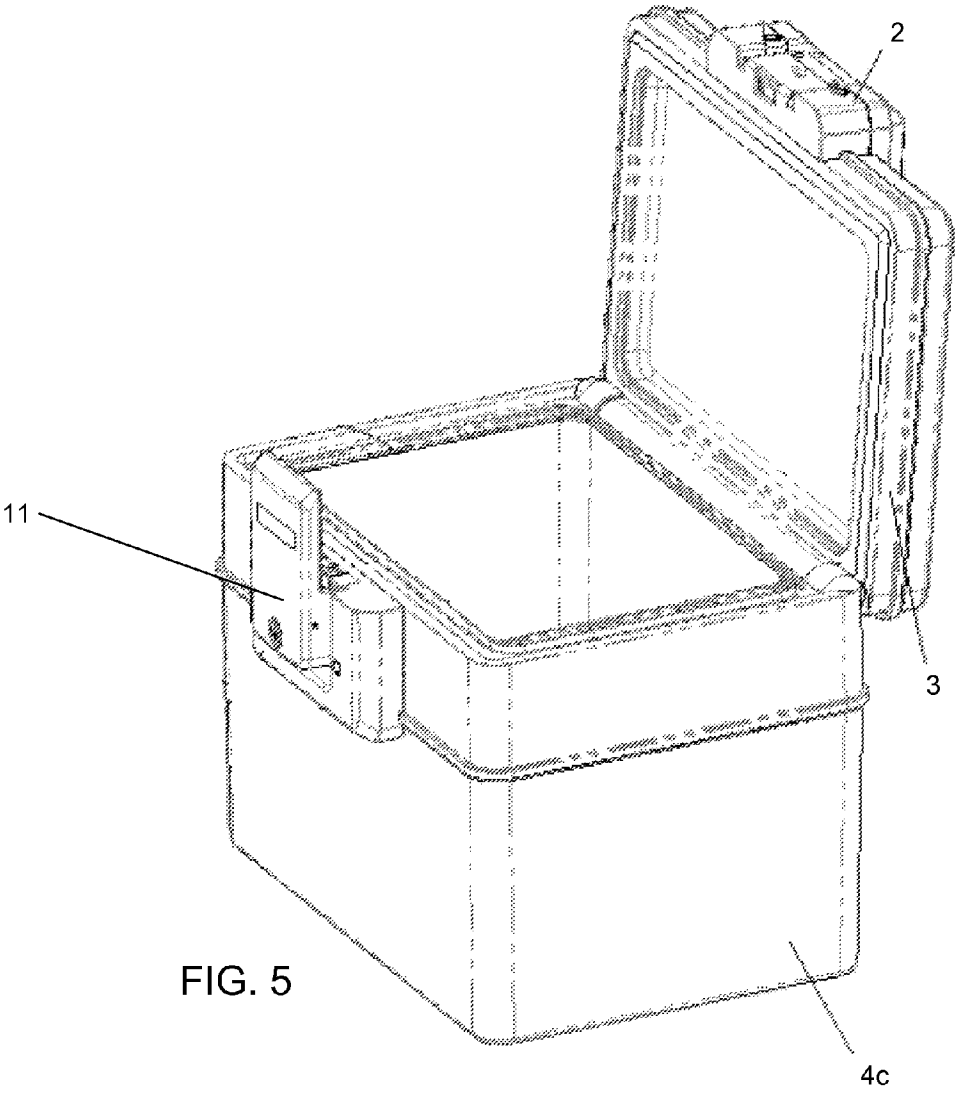
FIG. 5 shows another preferred embodiment of the present invention.

FIG. 5 shows another preferred embodiment having a larger box 4*c* for more storage capacity. FIG. 4B shows that safe 200 can be a fireproof safe. For example box 4 includes interior wall 54 and exterior wall 53 with fireproof insulation 55 between. To make safe 200 a fireproof safe, all walls of box 4 and lid 3 include insulation 53 sandwiched between interior and exterior walls. Also, it should be noted that box 4 and lid 3 can be fabricated from either plastic or metal.

Although the above-preferred embodiments have been described with specificity, persons skilled in this art will recognize that many changes to the specific embodiments disclosed above could be made without departing from the spirit of the invention. For example, it would be possible to modify the present invention so that fascia assembly 2 unlocks a separate mechanism that allows the user to then manually unlock the latch. The user could then manually unlock the safe by pressing a button or turning a knob, for example. Therefore, the attached claims and their legal equivalents should determine the scope of the invention.

What is claimed is:

1. A safe, comprising:

A. a safe lid,

B. a safe box connected to said safe lid via a hinge,

C. a fascia assembly connected to said safe lid, said fascia assembly comprising:

1) a keypad, 2) a fascia assembly locking groove, 3) a battery, 4) a microprocessor, 5) a fascia assembly electrode, D. a latch assembly mounted on said safe box, said latch assembly comprising:

1) a movable lock latch, 2) a latch defining an upper portion and a lower portion, comprising a) a fascia assembly locking tab on the upper portion adapted to engage said fascia assembly locking grove, and b) a lock latch locking tab on the lower portion adapted to engage said movable lock latch, 4) a gear and a connecting plate, 5) a lock lever pivotally connected to said latch and said latch assembly, 6) a latch assembly electrode adapted to receive electric power from the fascia electrode, 7) a motor adapted to receive electrical inputs from said key pad via the latch assembly electrode and to drive said gear to cause the gear to move the connecting plate so as to cause the movable lock latch to move from a locked position to an unlocked position or from an unlocked position to a locked position, 8) a lock latch reset spring adapted to push the movable lock latch into its locked position, and 9) a key lock for moving said movable lock latch from a locked position to an unlocked position or from an unlocked position to a locked position, wherein said safe is locked when said fascia assembly locking tab is inserted into said fascia assembly locking groove and when said lock latch locking tab is behind said movable lock latch, wherein said safe is opened by entering a pass code into said key pad causing an electrical signal to transmit to said motor causing said movable lock latch to move clear of said lock latch locking tab so as to release said lock latch locking tab and so as to compress said lock latch reset spring, wherein said safe is also opened by turning said key lock causing said movable lock latch to move clear of said lock latch locking tab so as to release said lock latch locking tab and so as to compress said lock latch reset spring.

2. The safe as in claim 1, wherein said safe is a fire safe.

3. The safe as in claim 1, wherein said safe is fabricated from plastic.

4. The safe as in claim 1, wherein said safe is fabricated from metal.

* * * * *